United States Patent [19]

Wilson et al.

[11] Patent Number: 4,765,609

[45] Date of Patent: Aug. 23, 1988

[54] AUTOMATED BOXING MACHINE

[75] Inventors: Jerry L. Wilson, 485 NW. 170th Dr., Beaverton, Oreg. 97005; Gerald E. Nagode, Aloha, Oreg.

[73] Assignee: Jerry L. Wilson, Beaverton, Oreg.

[21] Appl. No.: 6,779

[22] Filed: Jan. 27, 1987

Related U.S. Application Data

[63] Continuation-in-part of Ser. No. 896,880, Aug. 15, 1986, abandoned.

[51] Int. Cl.[4] ..... A63B 69/00

[52] U.S. Cl. ..... 272/76

[58] Field of Search ..... 272/76–78, 272/93; 446/332–336; 273/55 R

[56] References Cited

U.S. PATENT DOCUMENTS

| | | | |
|---|---|---|---|
| 835,796 | 11/1906 | Lindsley | 272/76 |
| 952,862 | 3/1910 | Armstrong | 272/76 |
| 2,909,370 | 10/1959 | Fortney | 272/76 |
| 2,934,343 | 4/1960 | Schumacher | 273/55 R |
| 3,250,533 | 5/1966 | Nicholson, II | 272/76 |
| 3,281,148 | 10/1966 | Cummins | 272/78 |
| 4,553,946 | 11/1985 | Miller | 446/334 |
| 4,564,192 | 1/1986 | Lobowitz | 272/76 |
| 4,660,827 | 4/1987 | Seruadio | 272/78 |

FOREIGN PATENT DOCUMENTS

| | | | |
|---|---|---|---|
| 0563984 | 8/1977 | U.S.S.R. | 272/76 |
| 0602200 | 4/1978 | U.S.S.R. | 272/76 |

*Primary Examiner*—Richard J. Apley
*Assistant Examiner*—S. R. Crow
*Attorney, Agent, or Firm*—Chernoff, Vilhauer, McClung & Stenzel

[57] ABSTRACT

The exercise machine of the present invention is comprised of articulated arms which can be moved between retracted cocked positions and extended punching positions in order to simulate the throwing of a punch. The upper portions of the arms are in the form of parallelogram linkages which allow them to be moved between extended and retracted positions at their point of connection with the body of the machine. A shoulder, which rotates about the post which supports the machine activates the parallelogram linkages so as to extend the arm attached to the side of the shoulder which is moved forward and retract the arm on the side of the shoulder which is moved rearward. A motor, which causes the shoulder to rotate is activated by a control system. A microprocessor associated with the control system permits the machine to be preprogrammed to throw a series of punches in particular combinations to give the appearance of an actual boxer.

13 Claims, 3 Drawing Sheets

AUTOMATED BOXING MACHINE

This a continuation-in-part of application Ser. No. 896,880 filed Aug. 15, 1986, now abandoned.

BACKGROUND AND SUMMARY OF THE INVENTION

This invention relates to a machine that simulates a human boxer by throwing punches at a user and receiving punches thrown by the user in return.

The need for continued aerobic exercise is essential in order to maintain cardiovascular fitness and muscle tone and to prevent weight gain. Those whose normal activities do not provide sufficient exercise to meet these needs must engage in a regular exercise program which does. However, home exercises are by nature repetitive and thus quickly become boring for most people. As a result, it becomes difficult to continue with a home exercise program and many people fail to exercise on a regular basis even after having spent a considerable sum for equipment which facilitates the process.

The present invention provides an exercise device which not only permits the user to achieve a high level of aerobic activity but does so in a manner which most people find entertaining, and which by its very nature motivates people to continue its use on a regular basis.

This is accomplished by providing a machine which looks like a boxer and throws punches repeatedly when in operation and which can be punched by the user in return, without injury to either the machine or the user. The user must continue to remain in motion when using the machine or be hit. Furthermore, stepping away from the machine is psychologically difficult, since doing so is an admission that the machine has won. Therefore, the user will be driven to continue exercising with the machine once started, and competetive instinct will cause the user to continue to use the machine on a regular basis. By varying the speed at which the punches are thrown and the frequency at which they are repeated, the machine can be adjusted to accommodate people with a wide variety of exercise capability and boxing skill thereby allowing it to be used by almost anyone.

The machine comprises a pair of simulated arms one of which is attached to each end of a shoulder assembly by rotatable joints. The arms are divided into upper and lower portions which are joined together through hinged joints. The upper portion is a four-bar parallelogram linkage, with the extremities of both long bars having independent joints. Thus if one of these joints is moved away from the other joint the upper and lower arm portions rotate away from each other and become more horizontal and the arm is extended. On the other hand if the two joints are moved together the arm portions rotate toward one another and the arm is retracted.

Relative movement of the joints is achieved by the shoulder assembly which they are attached to having two links, one which swings upon shoulder rotation and one which remains stationary. The two shoulder links are approximately the same length but the stationary link has articulated end portions. The ends of the swinging link, which is located forwardly of the stationary link, are attached to the forward joints of the upper arm portions, and the ends of the stationary link are attached to the rearward joints of the upper arm portions. When one end of the swinging link is rotated forward the articulated end of the stationary link follows it but does not move as far forward. Thus, as one side of the shoulder is moved forward the rearward joint moves toward the forward joint and the arm is extended. As a result the device duplicates a normal punching action by simultaneously moving the arm forward at the shoulder as it is extended.

The stationary shoulder link is attached to a fixed support which is carried in an upright position by means of a base. In a first embodiment of the invention the base comprises tanks which are filled with water or sand to provide the weight necessary to stabilize the device and absorb a portion of the energy resulting from the machine throwing or receiving a punch. In a second embodiment of the invention, the base comprises an articulated support having a dampening cylinder which absorbs the punching energy. The swinging shoulder link is attached to a rotating support which is coaxial with the fixed support and which rotates relative to it. A motor, having a first sprocket driven by it, is attached to the fixed support and a second sprocket is attached to the rotating support co-planar with the first sprocket. A belt, having cleats which engage the sprockets, rotatably interconnects them. Thus, the shoulders swing clockwise, looking from above, when the motor is rotated in one direction, to extend the left arm and retract the right arm, and counter-clockwise when the motor is rotated in the other direction, to extend the right arm and retract the left arm.

A controller, which can be activated by either a microprocessor or manual controls, operates the motor in the proper direction and at the desired speed. The microprocessor also can be programmed to make the machine throw combinations of punches in predetermined patterns in order to simulate an actual boxer.

Located on the rotating support, below the shoulder, is a series of thin oblong hoops which simulate the boxer's ribs. The ribs, as well as the arms, are made of an ultrahigh molecular weight polyethylene and thus are strong enough to withstand a high impact without breaking and yet flexible enough not to injure the user, even when a punch makes direct contact. A simulated fist is located at the extremities of each arm and a simulated head is placed on top of the fixed support. The entire device is covered with a foam wrap, which, along with the flexibility of the ribs, allows users to hit the machine without injuring themselves.

Accordingly, it is a principal object of the present invention to provide an exercise machine which can throw punches and which can receive punches in return.

It is a further object of the present invention to provide such a machine in which the arms move forward and extend simultaneously when a punch is being thrown.

It is a further object of the present invention to provide such a machine which can be programmed to throw a prearranged series of punches or can be manually controlled to throw individual punches upon command.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
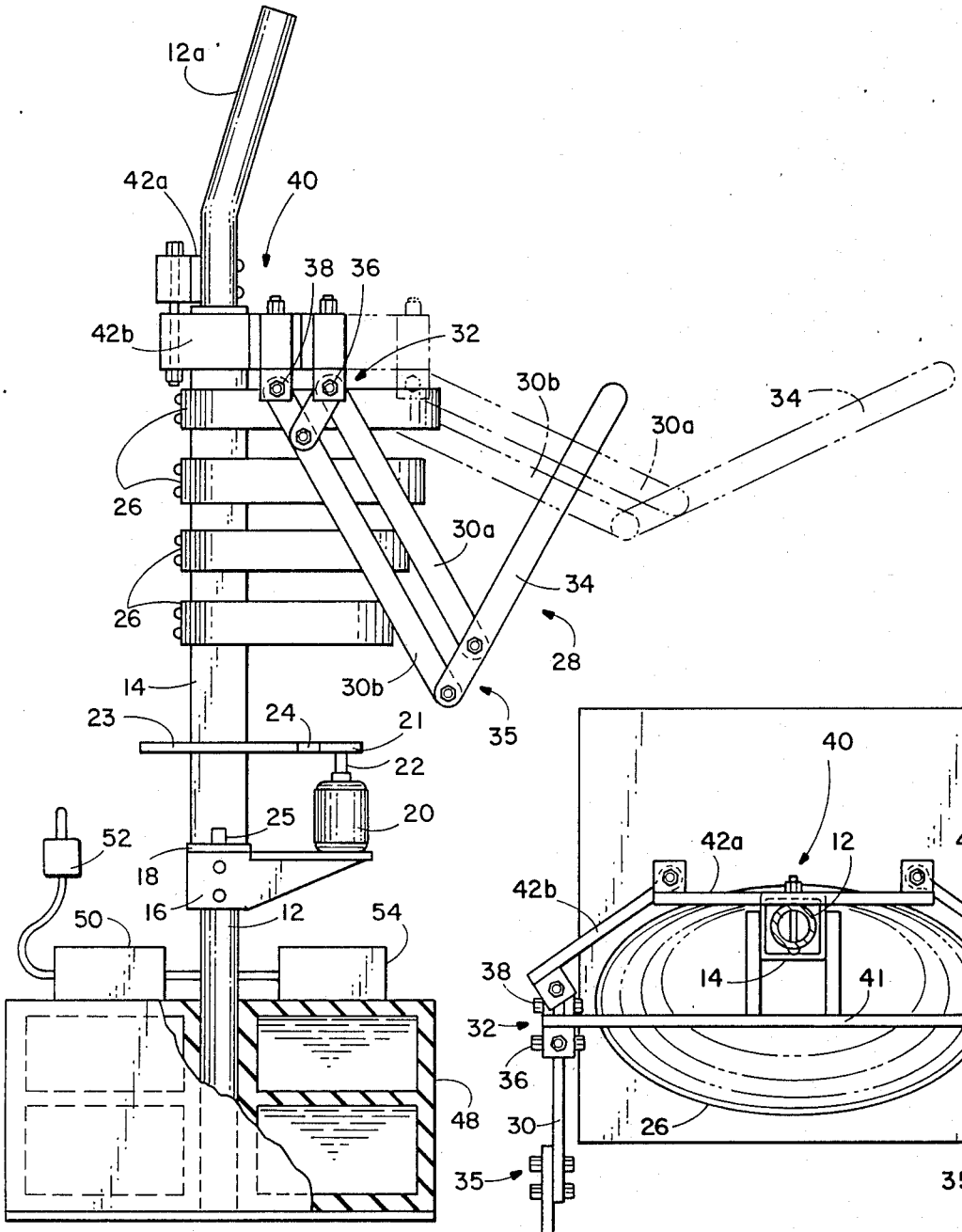
FIG. 1 is a side elevational view, partially broken away to show hidden detail, of a boxing machine embodying the features of the present invention, with one of its arms being shown in an extended position in dashed line.

Referring to the drawings, the boxing machine of the present invention is carried by an upright support 10 comprising a fixed portion 12, which generally is as long as the machine is tall, and a rotating portion 14, which is shorter than the fixed portion and is rotatably mounted on it. The fixed portion 12 is cylindrical in the embodiment illustrated, and its upper end 12*a* is angled forwardly. A platform 16, attached to the fixed portion 12 immediately below the bottom of the rotating portion 14, contains a thrust bearing 18 which positions the rotating portion longitudinally on the fixed portion and permits it to rotate relative thereto. An electric motor 20, which is mounted on the platform 16, has a first sprocket 21 attached to its output shaft 22. A second sprocket 23, which has a considerably larger diameter than the first sprocket 21, is attached to the rotating portion of the support. A continuous belt 24, having cleats formed in its inner surface, fits around the first and second sprockets and rotatably joins them. Limit switches 25 located on the platform 16 prevent rotation of the rotating portion relative to the fixed portion beyond predetermined limits. Thus, the rotating portion rotates clockwise relative to the fixed portion when the motor is run in one direction and counterclockwise when the motor is reversed.

Attached to the fixed portion 12 of the support 10 are several simulated ribs 26. The ribs are in the form of oval hoops and are made from an ultra high molecular weight polyethylene. Thus, they are flexible enough to easily be deflected when hit and yet will not break. In addition, the deflection of the ribs when they are hit, absorbs a portion of the energy of a punch and thus helps prevent the machine from being tipped over. The size of the ribs varies progressively along the support with the top one having a larger hoop size than the bottom one.

Attached to the upper end of the rotating portion of the support are a pair of simulated arms 28 which can be moved between a retracted or cocked position (solid line position in FIG. 1 and an extended or punching position (dashed line position in FIG. 1). In order to achieve this movement, the arms are divided into upper portions 30, which are rotatable about first hinged joints 32, and lower portions 34 which are rotatably attached to the upper portions by means of second hinged joints 35. The arms preferably are constructed from the same material that the ribs are.

In order to facilitate movement between the retracted and extended positions, the upper arm portions 30 comprise four-bar parallelogram linkages, and the first hinged joints 32 comprises forward pivots 36, which are located at the ends of one of the longer bars 30*a* of the linkages and rearward pivots 38, which are located at the ends of the other longer bars 30*b* of the linkages. The inner portions of the lower arms 34 comprises one of the shorter bars of the parallelogram linkage and the linkage is arranged such that when the forward and rearward pivots 36 and 38 are moved apart the upper and lower arms rotate away from one another and become more horizontal, and when the forward and rearward pivots are moved together the upper and lower arms rotate toward one another and become more vertical.

Figure 3:
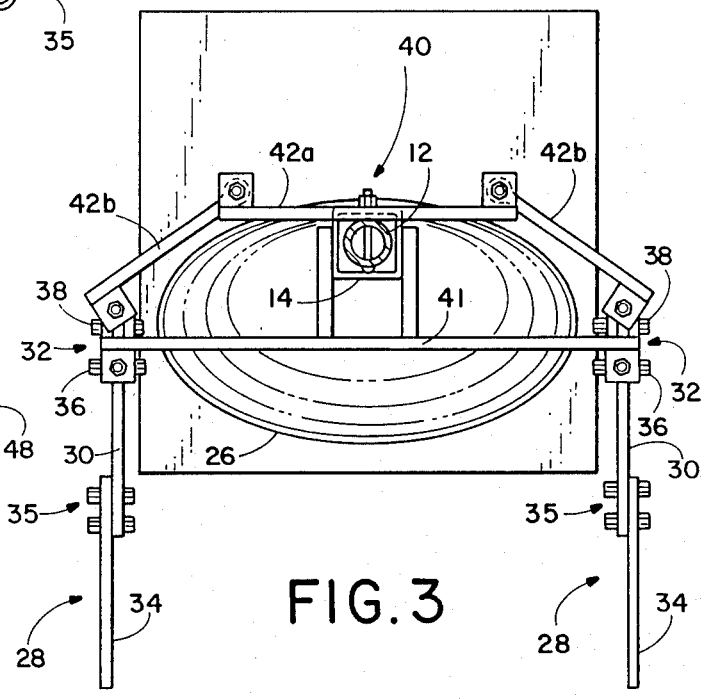
FIG. 3 is a plan view of the boxing machine.
Figure 2:
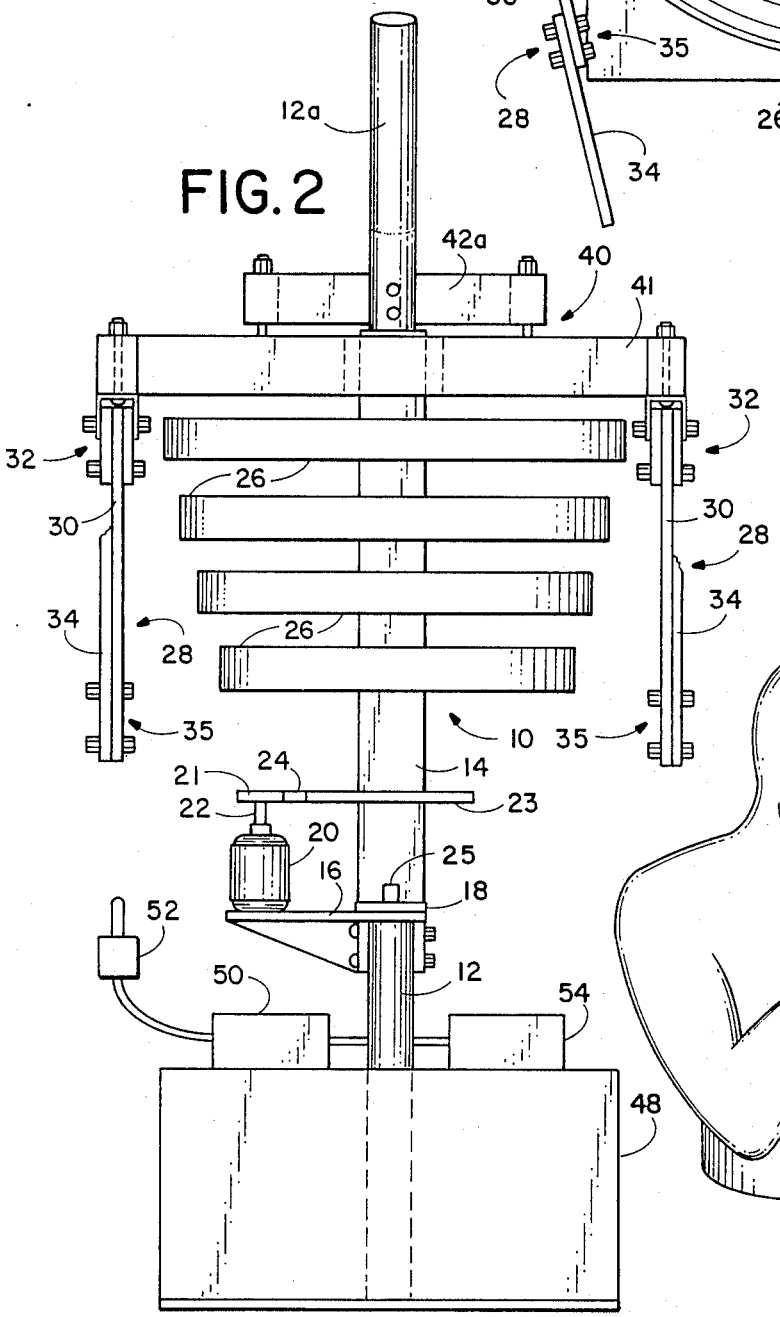
FIG. 2 is a front elevational view of the boxing machine.
Figure 4:
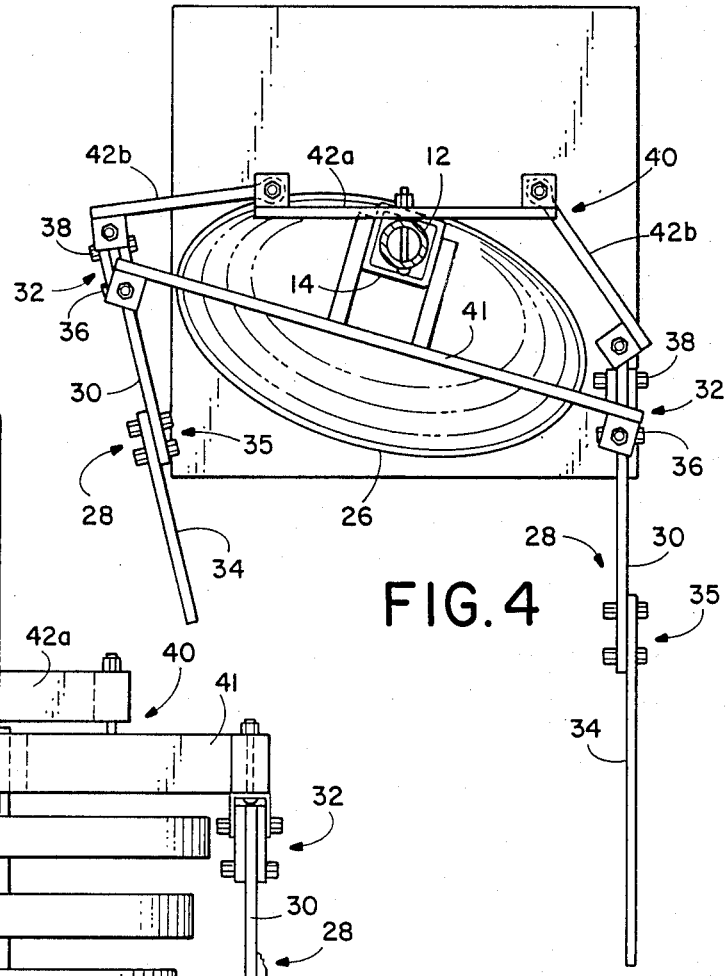
FIG. 4 is a plan view of the boxing machine with the shoulder rotated.

This relative movement of the forward and rearward pivots is accomplished by means of a simulated shoulder 40, which is best seen in FIGS. 3 and 4. The shoulder comprises a swinging link 41 which is attached to the rotating portion 14 of the support 10, and a stationary link 42 which is attached to the fixed portion 12 of the support. The ends of the swinging link 41 carry the forward pivots 36, and the ends of the stationary link carry the rearward pivots 38. The stationary and swinging links have approximately the same length, however, the outer portions 42*a* of the stationary link are articulated with respect to the center portion 42*b*. As a result, while both the forward and rearward pivots 36 and 38 in an arm are moved forward when the side of the shoulder attached to that arm is rotated forwardly, the rearward pivot is not moved as far forward as the forward pivot, due to the rotation of the outer portion 42*a* of the stationary link, FIG. 4. As a result, when the shoulder is rotated the arm attached to the side which is moved forward is extended and the arm attached to the side which is moved rearward is retracted giving a natural punching action with the shoulder rotating forwardly simultaneously with the extension of the arm.

Figure 5:
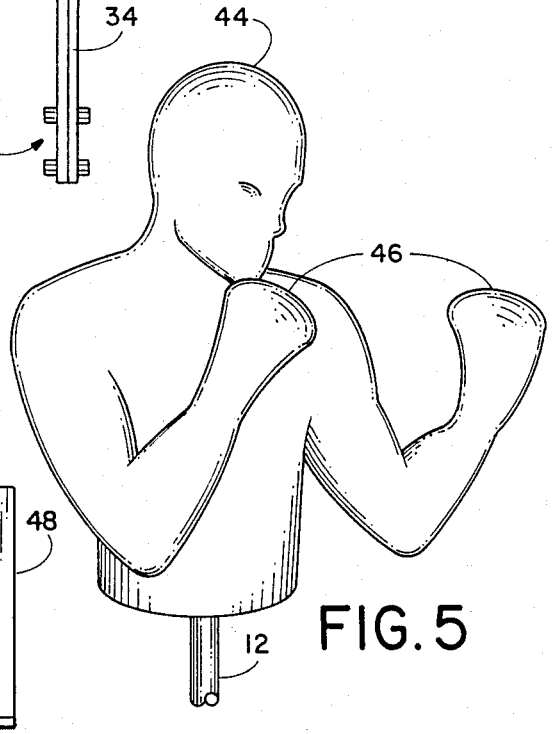
FIG. 5 is a view of the boxing machine fully wrapped.

Referring to FIG. 5, a simulated head 44 is mounted on top of the fixed support portion 12, and simulated gloved fists 46 are mounted at the extremities of the lower arm portions. The entire device is then wrapped with a foam skin to give it a human appearance. The machine is held in an upright position by means of a base which snugly receives the lower extremity of the fixed support.

In a first embodiment of the invention, shown in FIGS. 1–4, the base comprises a series of resilient tanks 48 which mechanically interconnect to form an integral unit. The tanks are hollow in order to receive sand or water to provide the necessary weight in use without being overly heavy when being transported. In addition, the sand or water will permit the base to be deflected when the machine throws a punch or is punched in return by the person using it. Thus, the energy created is dissipated and the machine does not move when in use.

Figure 6:
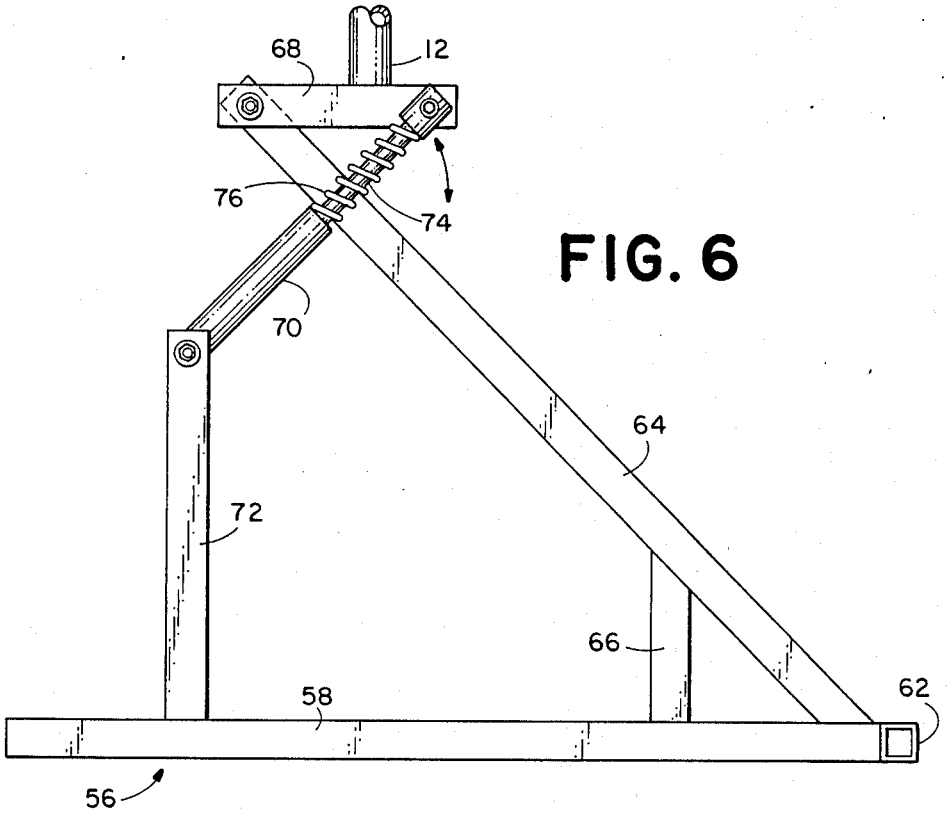
Figure 7:
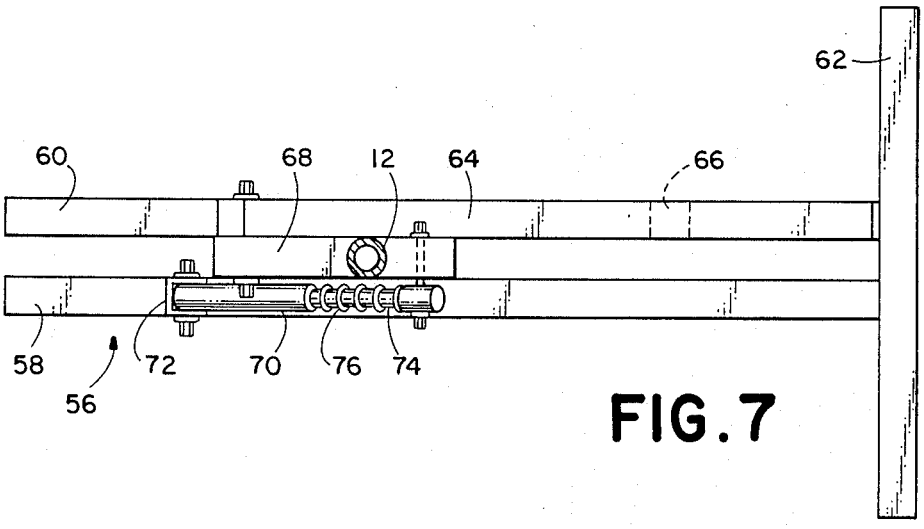

In a second embodiment of the invention, shown in FIGS. 6 and 7, the base comprises a foot 56 which is formed from two parallel, spaced apart box beams 58, having one end attached to the center of a shorter box beam 60 to form a T-shaped end. Extending upwardly at approximately a 45° angle from the box beam 60, near the T-end of the foot 56, is a brace 64 which has approximately the same length as the box beams 56 and 58. Thus, the end of the brace lies slightly inwardly from the end of the foot which is opposite the T-end. A short tie beam 66 extends between the brace and the foot to make the brace more rigid.

Rotatably attached to the upper extremity of the brace 64 is a short floating support 68. The fixed support 12 is connected to the floating support intermediate its ends with the two elements being perpendicular to one another. A pneumatic dampening cylinder 70 extends between the free end of the floating support and an upright post 72, which is attached to the foot 56. Thus the cylinder 70 resists downward movement of the floating support and absorbs a portion of the energy imparted to the machine by a punch. The piston 74 of the cylinder 70 is surrounded by a compression spring 76 which is sized to support the weight of the boxing machine with the floating support being parallel with the foot 56. The spring stores punching energy as it is compressed and directs its force in a direction opposite to that caused by the punches which prevents tipping of the machine. The spring also returns the machine to its normal upright position after it has received a punch.

In use, when the machine is punched or throws a punch the floating support 68 rotates against the piston 70 and spring 76 to absorb most of the force. The remaining force is transmitted through the brace 64 to the foot 56 which, due to its length, prevents the machine from tipping over.

A control system 50 initiates operation of the motor 20 to achieve rotation of the shoulder in the proper direction, and thus achieve extension of the associated arm. This can either be accomplished manually, by means such as a joy stick 52, or automatically, by means of a microprocessor 54. In the latter case a commercially available microprocessor can be programmed to throw a series of punches in combination in a predetermined cycle. In either case, the control system can include speed adjustment means for controlling the rotational speed of the motor, and thus the speed of the punches thrown by the machine. Circuitry which will perform the foregoing control function can be devised easily by one skilled in the electronic arts.

In use, once the machine has been started the user can spar with it similarly to sparring with another person by attempting to block the punches being thrown by the machine and by punching the machine back. The ultra high molecular weight polymer used for the arms and ribs is sufficiently strong that it will not break under these circumstances and yet is sufficiently flexible that the punches thrown by the machine will not injure the user. The machine will maintain the user in an aerobic state as long as it is in operation unless the user steps back away from it. This is because merely defending oneself and blocking the punches thrown by the machine requries a high level of output and if one doesn't continue doing so he will be hit by the machine. Throwing punches in return adds to the activity level of the user, and, in addition, will cause development of a wide variety of muscles in the upper body and legs. Unlike most forms of aerobic exercise which can be performed in the home, the boxing machine of the present invention maintains the interest level of the user, and as a result, is not burdensome to use. Thus, the user is more likely to continue the exercise program on a regular basis.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise machine which simulates a human boxer by throwing punches at and receiving punches throuwn by the user, comprising:

(a) an upright support;

(b) a simulated shoulder element having opposed ends, said shoulder element being attached intermediate said ends to said support;

(c) means for rotating said shoulder element about said support;

(d) a pair of simulated arms having first ends which are attached to the ends of said shoulder element and second ends which have simulated glove fists located thereon;

(e) linkage means associated with said shoulder element and said arms for moving the arm which is attached to the end of said shoulder element which is being rotated toward its associated arm to an extended position and moving the arm which is attached to the end of said shoulder element which is being rotated away from its associated arm to a retracted position;

(f) wherein said linkage means includes first hinged joints which are located at said first ends of said arms with the first hinged joint of one of said arms being attached to each of the ends of said shoulder element, and second hinge joints which are located medially on said arms; and (g) said upright support includes a fixed portion and a rotating portion wich can be rotated relative to said fixed portion, and said shoulder element is attached to said rotating portion.

2. The machine of claim 1, including means for controlling the speed at which said shoulder element rotates.

3. The machine of claim 1, including means for repeatedly rotating sid shoulder element first in one direction and then in the opposite direction.

4. The machine of claim 3, including means for controlling the frequency at which the rotational direction of said shoulder element is reversed.

5. The machine of claim 1, including means for rotating said rotating portion in either direction relative to said fixed portion.

6. The machine of claim 5 wherein said means for rotating comprises:

(a) an electric motor;

(b) a first sprocket which is rotatably driven by said motor;

(c) means for attaching said motor to one of said fixed portion or said rotating portion;

(d) a second sprocket which is co-planar with said first sprocket and is attached to the other of said fixed portion or said rotating portion; and (e) belt means for rotatably connecting said second sprocket with said first sprocket.

7. The machine of claim 1, including a base which receives said support means and supports it so that said shoulder element is horizontal.

8. The machine of claim 7, including resilient means associated with said base for absorbing the shock created by the operation of said boxing machine and preventing said base from moving.

9. The machine of claim 8 wherein said base means comprises:

(a) an elongate foot which is oriented generally perpendicular to said support means, said foot being T-shaped at a first end thereof;

(b) an elongate floating support which is oriented medially above and parallel with said foot;

(c) brace means for connecting the end of said floating support which is furthest from the first end of said foot rigidly to said first end, said floating support being rottable with respect to said brace means;

(d) dampener means for resisting the movement of said floating support towards said foot;

(e) means for returning said floating support to a null position where it is parallel with said foot when it has been rotated towards said foot from said null position; and (f) means for attaching said fixed portion of said support means to said floating support.

10. The machine of claim 1 wherein each said arm comprises an upper portion which lies between said first and second hinged joints and a lower portion, said upper portion including a four-bar parallelogram linkagage and said first hinged joint including a forward pivot and a rearward pivot, said parallelogram linkage being oriented such that moving said forward and rearward pivots towards one another causes said upper and lower arms to become more vertical and moving said forward and rearward pivots away from one another causes said upper and lower arms to become more horizontal.

11. The machine of claim 10 wherein said shoulder element comrpises:

(a) a stationary link which is connected medially to said fixed portion of said support means and has articulated end portions which are attached to said rearward pivots; and (b) a swinging link which is connected medially to said rotating portion of said support means and has end portions which are attached to said forward pivots.

12. The machine of claim 1, including ribs which surround said support means.

13. The machine of claim 12, including padded skin which covers said arms, shoulders and ribs.

* * * * *

UNITED STATES PATENT AND TRADEMARK OFFICE

CERTIFICATE OF CORRECTION

PATENT NO. : 4,765,609

DATED : August 23, 1988

INVENTOR(S) : Jerry Wilson, et al.

It is certified that error appears in the above-identified patent and that said Letters Patent is hereby corrected as shown below:

| | |
|---|---|
| Col. 3, line 57 | After "Fig. 1" insert --)-- |
| Col. 6, line 3 | Change "throuwn" to --thrown-- |
| Col. 6, line 26 | Change "hinge" to --hinged-- |
| Col. 6, line 29 | Change "wich" to --which-- |
| Col. 6, line 37 | Change "sid" to --said-- |
| Col. 7, lines 19-20 | Change "linkagage" to --linkage-- |

Signed and Sealed this

Twentieth Day of March, 1990

*Attest:*

JEFFREY M. SAMUELS

*Attesting Officer*

*Acting Commissioner of Patents and Trademarks*